United States Patent [19]

Timperi et al.

[11] Patent Number: 4,900,224

[45] Date of Patent: Feb. 13, 1990

[54] CENTRIFUGAL PUMP STRUCTURE

[76] Inventors: Jukka Timperi, Kasilanpolku 18 A 7, SF-48400 Kotka; Reijo Vesala, Lohniementie 29, SF-48300 Kotka, both of Finland

[21] Appl. No.: 323,342

[22] Filed: Mar. 14, 1989

[30] Foreign Application Priority Data

Mar. 15, 1988 [FI] Finland ..... 881203

[51] Int. Cl.[4] ..... F04D 29/62; F16M 7/00

[52] U.S. Cl. ..... 415/213.1; 418/39; 248/637; 417/360

[58] Field of Search ..... 415/213.1; 417/360, 417/423.15; 418/39; 248/207, 637, 674, 676; 60/39.31

[56] References Cited

U.S. PATENT DOCUMENTS

| | | | |
|---|---|---|---|
| 1,993,999 | 3/1935 | La Bour | 415/213.1 |
| 2,316,608 | 4/1943 | McMahan | 415/213.1 |
| 2,469,936 | 5/1949 | Tabbert | 418/39 |
| 3,022,740 | 2/1962 | Wilfley et al. | 415/213.1 |
| 3,257,956 | 6/1966 | Logue et al. | 417/360 |
| 3,369,783 | 2/1968 | Keating | 248/637 |
| 3,791,760 | 2/1974 | Lipe | 415/213.1 |
| 3,891,345 | 6/1975 | Doolin | 415/213.1 |
| 4,019,704 | 4/1977 | Levine | 248/637 |

FOREIGN PATENT DOCUMENTS

| | | | |
|---|---|---|---|
| 118949 | 9/1979 | Japan | 248/637 |
| 1440822 | 6/1976 | United Kingdom | 418/39 |

*Primary Examiner*—Robert E. Garrett
*Assistant Examiner*—Hoang Nguyen
*Attorney, Agent, or Firm*—Cohen, Pontani & Lieberman

[57] ABSTRACT

A centrifugal pump mounting structure which allows easy, sturdy, and reliable mounting of a pump on a support bed in several different attitudes. The mounting system of the present invention includes legs situated at the opposite side of the pump to that of the pressure outlet opening and on both sides of the longitudinal plane passing through the pump shaft and the pressure outlet opening; in which the legs have two planar surfaces for mounting of the pump; and in which there are, on both sides of the pressure outlet opening substantially in the longitudinal plane passing through the shaft of the pump, brackets with planar mounting surfaces for mounting the pump.

16 Claims, 5 Drawing Sheets

CENTRIFUGAL PUMP STRUCTURE

BACKGROUND OF THE INVENTION AND THE PRIOR ART

The present invention relates to a centrifugal pump mounting structure which allows easy, sturdy, and reliable mounting of the pump on its bed in several different dispositions or attitudes.

A few different basic structures have conventionally been used in the so-called end suction centrifugal pumps to suspend or mount the pump on a bed or bed plate. These prior art structures are illustrated in FIGS. 1, 2 and 3 of the drawings herein. FIG. 1 illustrates a pump, the body of which is mounted on its bed by bolts so as to make it possible to turn the casing of the pump to different positions allowed by the bolts. This kind of mounting involves some disadvantages, for instance pipe line forces cause distortions and the whole mounting has to be dismounted for service of the bearing part of the pump.

More modern process pumps generally employ the structure illustrated in FIGS. 2A and 2B which eliminates the disadvantages discussed above. A drawback of this FIGS. 2A and B structure is that this kind of a pump mounting can be used to mount a pump on a conventional bed in only one position, in most cases with the pressure outlet opening facing straight upwards, which position is determined by the support legs. This kind of mounting results in problems particularly when high consistency stock is pumped from a stock vessel or when the stock to be pumped must be taken on the same level to another device, e.g. to a beaching tower which is fed from below. In the first mentioned case problems are caused by the stock flow piping which is usually remarkably expanded or enlarged just after the pump in order to avoid unnecessary flow resistance. When the pump is situated by the side of the stock vessel and the pressure opening is directed upwards, the distance between the pressure pipe from the pump and the vessel is so short that the enlargement required in the piping cannot be arranged without a bend in the pressure pipe. As this bend or elbow is by means of a rather narrow pipe, the flow resistance will be quite high. This kind of resistance could be avoided altogether by arranging the pressure opening of the pump facing sidewards in which case the curved surface of the stock vessel would give space for the enlargement of the piping immediately after the pressure opening. In the second case where stock is to be taken on the same level from one device to another the problem is the same since a bend or elbow is needed in the vertical pressure pipe to turn the stock flow to the same level with the subsequent device. This bend causes the same flow loss as the bend in the first case.

FIGS. 3A and 3B illustrate a typical process pump for hot liquids which pump is mounted at the center line of the pump in order to avoid distortions caused by thermal elongation. This kind of a pump presupposes quite an expensive support structure in the bed if sufficient sturdiness is to be achieved.

Further, different positions of the pump require different structures of the bed.

None of the above prior art structures which are commonly used, meets the requirements of a good mounting for a pump; the most important requirements are:

good strength and rigidity in view of the pipe line forces;

that the parts of the pump (bearings, impeller, sealing) which require service must be detachable from the pump without the need to detach the casing from the piping;

that the positions of the pump must be changeable without complex bed structures or necessary changes in the structure of the bed;

that the structure must be inexpensive and readily manufactured.

The centrifugal pump mounting structure of the present invention well meets all these basic requirements. Further, the pump structure of the present invention provides great advantages in standardization of the manufacture of pumps and in reducing the costs of manufacture. Further, one and the same pump can be used for several different purposes and in several different positions or attitudes without beds or special structure.

The centrifugal pump structure of the invention is characterized in that the legs are situated spaced apart at the opposite sides of the pump to the pressure outlet opening and on opposite sides of a longitudinal plane passing through the pump shaft and the pressure outlet opening; that the legs each have first and second planar surfaces extending in different directions for mounting of the pump; and that there is on one side or are on opposite sides of the pressure connection and substantially in the longitudinal plane passing through the shaft of the pump, a bracket or brackets with planar mounting surfaces.

BRIEF DESCRIPTION OF THE DRAWINGS

The centrifugal pump structure of the invention is described more specifically in the following description, by way of example, with reference to the accompanying drawings, in which.

DETAILED DESCRIPTION OF PREFERRED EMBODIMENTS

Figure 1:
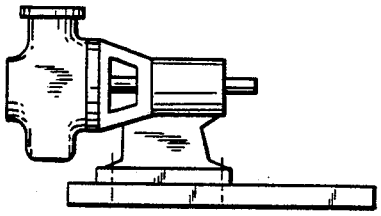
FIG. 1 PRIOR ART
FIG. 1 is a diagrammatic side view of a centrifugal pump with a prior art mounting structure as previously described.
Figure 2A:
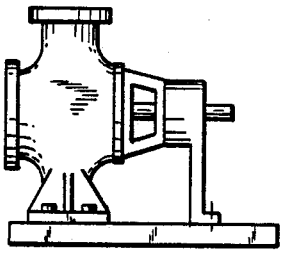
FIG. 2A PRIOR ART
FIGS. 2A and 2B are respectively side and rear elevational views of a centrifugal pump with another prior art mounting structure as previously described.
Figure 2B:
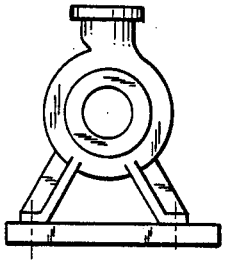
FIG. 2B PRIOR ART
Figure 3A:
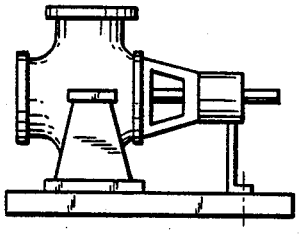
FIG. 3A PRIOR ART
FIGS. 3A and 3B are respectively side and rear elevational views of a typical centrifugal process pump for hot liquids with still another prior art mounting structure as previously described.
Figure 3B:
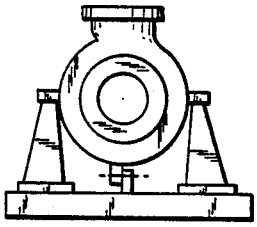
FIG. 3B PRIOR ART
Figure 4:
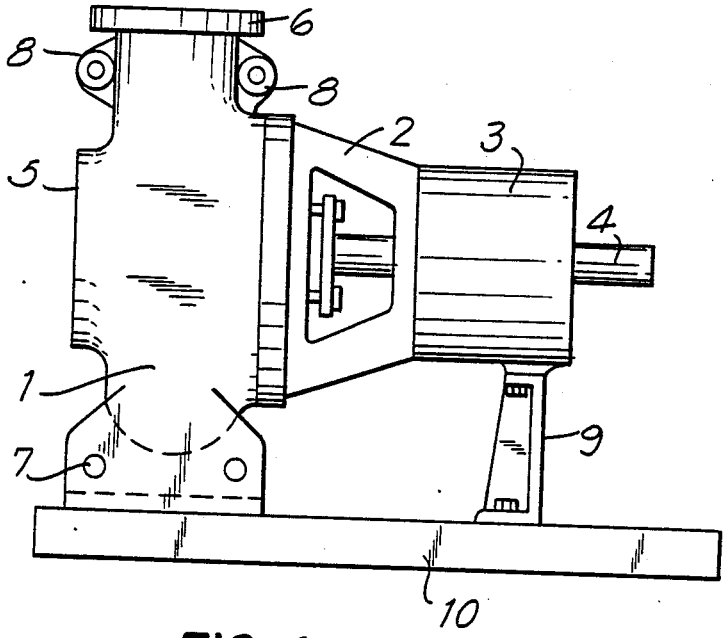
FIG. 4 is a side elevational view of a centrifugal pump with mounting structure in accordance with the preferred embodiment of this invention.
Figure 6:
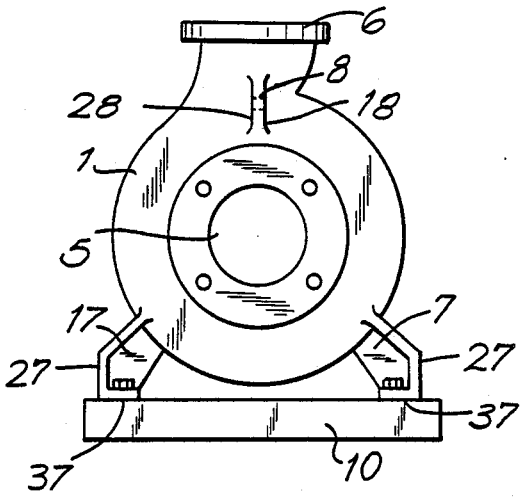
FIG. 6 is a front elevational view of the pump and mounting structure of FIG. 4 mounted with the pressure outlet openings extending vertically upward.

FIGS. 4 and 6 illustrate a centrifugal pump which mainly comprises a casing 1, a pump body 2, bearing housing 3, shaft 4, an inlet or suction opening 5 in the casing, an outlet or pressure opening 6 and an impeller (not shown) assembled in the casing on the 4. The casing 1 of the pump is provided with stationary legs 7, 17 which are on opposite side regions of the pump casing to that of the pressure opening 6 and, furthermore said legs 7, 17 are on opposite sides of the plane passing through the center of the pressure outlet opening 6 and the pump shaft 4. Further, there are at least one and preferably two brackets 8 located on both sides of the pressure outlet opening 6 in the casing substantially in the longitudinal plane in which the axis of the shaft 4 of the pump lies. The legs 7, 17 are provided with two planar mounting surfaces 27, 37 preferably disposed at right angles relative to each other and holes for securing screws have been drilled in the planar mounting surfaces. The brackets 8 each have an opposite sides planar mounting surfaces 18, 28 provided with one or more drilled holes for mounting screws. The mounting surfaces 18, 28 can be planar over the whole of each side or they can be machined portions thereof as counterbores around the mounting holes and concentric with such, as shown in FIG. 4. Further the pump may have an additional support leg 9 fixed to the bearing housing 3 or to the pump body 2.

FIGS. 4 and 6 illustrate pump which is mounted on a bed 10 in an attitude with the pressure opening 6 facing upwards. In this case the pump can be mounted straight on mounting surfaces 37 of the legs 7, 17; and if necessary with the additional support leg 9 under the bearing housing 3 or the pump body 2 (FIG. 4).

Figure 5B:
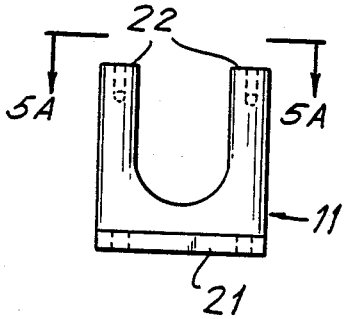
FIG. 5B is an elevational view of an auxiliary support for the pump.
Figure 5A:
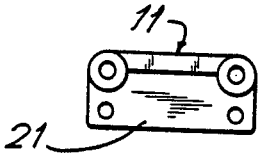
FIG. 5A is a view taken along the line A—A in FIG. 5B.

FIG. 5 illustrates an auxiliary support 11 of a preferred embodiment, which is needed when the pump is installed on the bed with the pressure outlet opening 6 sidewards. In the embodiment of the FIG. 5 the auxiliary support 11 is U-shaped viewed in a direction along the shaft 4 of the pump. The auxiliary support 11 is secured on the planar surface 21 of its lower part on the bed 10 and at the upper surfaces 22 of the free ends of its shanks forming a fork to the planar surfaces 18 or 28 of the brackets 8 adjacent the opening 6 of the pump, depending on the position of the pressure opening 6. The brackets 8 are preferably disposed lying in a plane in which in the center line of the pump shaft 4 also lies and which divides the pressure opening 6 whereby an equally dimensioned support 11 can be used irrespective of the direction in which the pressure opening faces.

Figure 7:
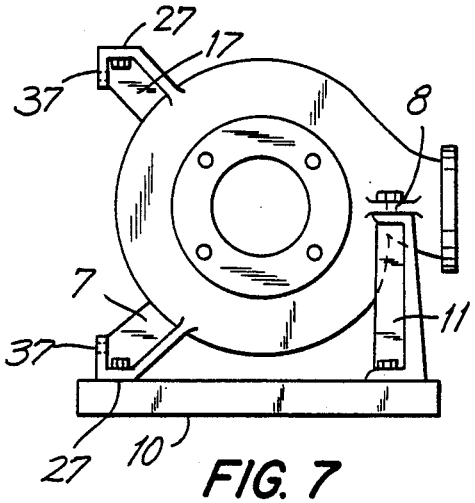
FIG. 7 is a view similar to FIG. 6 but showing the pump mounted with the pressure outlet opening horizontal and directed to the right.
Figure 8:
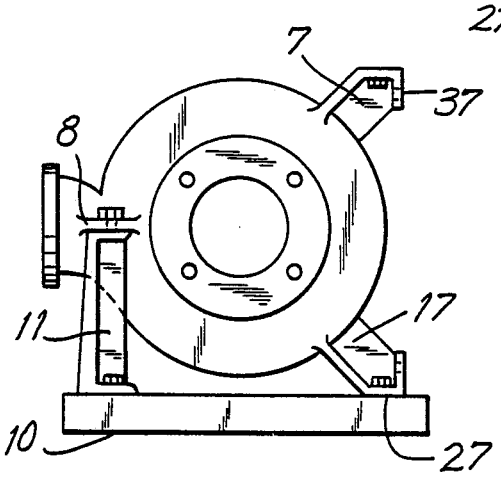
FIG. 8 is a view similar to FIGS. 6 and 7 but showing the pressure outlet opening horizontal and directed to the left.

FIG. 7 illustrates a pump which has been rotated 90 degrees on the right from the position of FIG. 4. The pump is in this case mounted to a bed 10 by the planar surface 27 of the leg 7, and by the auxiliary support 11 secured to the planar surface 18 of the brackets 8. Correspondingly, FIG. 8 illustrates a pump which has been rotated 90 degrees to the left from the position or attitude of FIG. 4. The pump is in this case supported on a bed 10 by the planar surface 27 of the leg 17, and by the auxiliary support 11 secured to the planar surface 18 of the brackets 8.

Figure 9A:
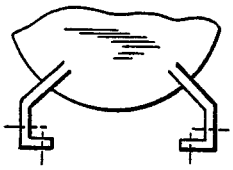
FIGS. 9A, B and C are diagrammatic front elevational views showing modification of leg supports in accordance with the invention.
Figure 9B:
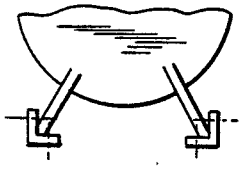
Figure 9C:
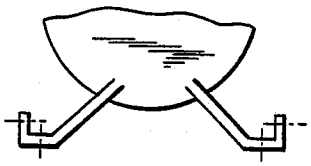

Further, FIGS. 9A, B and C illustrate three alternative embodiments of the structure of legs 7, 17. The important feature of the structures is that they have two planar surfaces with apertures provided, such as by drilling, possibly counter-sunk if desired. In most cases it is advantageous that the planar surfaces are at right angles to each other but in some cases also other angular relationships of the surfaces are possible. By changing the angular relationship the direction of the pressure opening can be made more or less inclined. In most cases changing the angle requires also changing the length of the leg to optimize the use of space on the bed.

The arrangement of the present invention gives another more important advantage when the legs 7, 17 and the brackets 8 of the casing and the auxiliary support 11 are manufactured so that the location of the mounting holes and the mounting surfaces in relation to the center lines of the pump are symmetric and preferably at the same distance from the center lines (central distance). Then the casing of the pump can be installed on one bed in three different positions as illustrated in FIGS. 6, 7 and 8. Correspondingly, it is advantageous to have an equal pitch and central distance of the mounting holes in the planar surfaces 27, 37 of the legs, and in the planar surface 21 of the auxiliary support 11 so as to require only one set of mounting holes in the bed for the three different mounting positions.

Figure 10A:
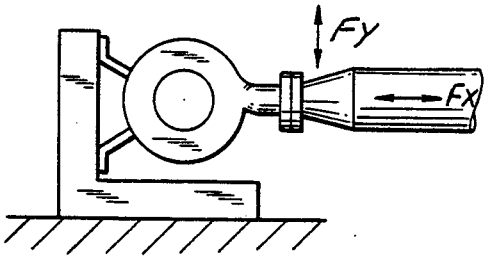
FIG. 10A PRIOR ART
FIG. 10A is a diagrammatic view of a pump mounted in accordance with the prior art.

The second remarkable advantage achieved with the invention is good strength and rigidity of the structure to resist pipe line forces. The mounting of the pump in the position illustrated in FIG. 6 is not very different from prior art mounting. On the other hand, when the pump is to be installed in a position where the pressure opening is directed to the side, as often is necessary when so-called MC pumps are used, a substantially stronger mounting is achieved than with conventional support structures wherein the pump must be mounted on vertical supports which are mounted on the bed as illustrated in FIG. 10A. In the structure of FIGS. 7 and 8 the stresses from the pressure pipe to the pump, which stresses are mainly parallel with the pipe, are transmitted mainly via the leg 7, 17, which are fixedly secured to the bed, and partly also via the auxiliary support 11 to the bed 10. In accordance with the invention, the mounting in the direction of the horizontal force component may be reinforced by having a structure preventing sliding in the joint between the leg of the casing and the bed. As may be seen in FIG. 10B, in the vertical direction the mounting 11 which is directed to the pressure connection of the pump and is arranged with the auxiliary support gives efficient support and may in some cases even take the place of a pipe support which would otherwise be needed.

The supports suggested for the load in the axial direction of the pump also give, if correctly constructed, excellent strength. The basic mounting or support of the casing can in all the installation positions be made remarkably more rigid if necessary by provision of an additional support 9 secured to the bearing 3 or to the pump body 2 (FIG. 4).

Figure 10B:
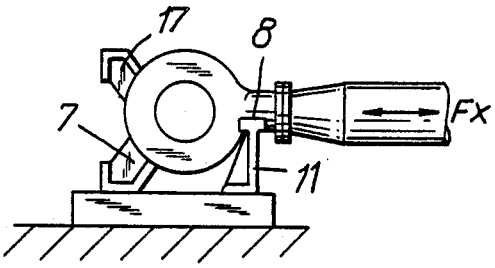
FIG. 10B is a diagrammatic view similar to FIG. 10A but showing the pump mounted in accordance with this invention.

FIGS. 10A and B illustrate an example of a comparison between a conventional mounting of a pump (FIG. 10A) and the mounting of a pump according to the present invention (FIG. 10B) when the pressure opening of the pump is directed to the side. As the two figures establish, the mounting according to FIG. 10B is clearly simpler and thus the structure of the bed is less expensive than the FIG. 10A mounting. When a bed with a vertical part, as in the FIG. 10A, is manufactured both the parts must have planar surfaces and the location of which in relation to each other has to be very precise. The planar surfaces for mounting the motor and the pump bearings have to be in the horizontal bed and the planar surfaces for the legs of the pump have to be in the vertical part of the bed. As regards the displacement caused by the pipeline forces $F_x$ and $F_y$ at the pump shaft, the forces in the prior art structure (FIG. 10A) are manifold compared with the forces in the structure according to the present invention if other dimensions of the pumps are corresponding. Thus the structure according to the invention essentially reduces the distortions and displacements in the pump caused by external forces and thus improves the durability of the bearings, sealings, power transmission, etc. of the pump.

Only a few advantageous embodiments of the centrifugal pump construction according to the present invention have been described in detail above, which embodiments are in no way intended to limit the invention. Many other structural alternatives within the scope of protection defined by the appended patent claims are also possible.

What is claimed is:

1. A centrifugal pump structure comprising an impeller casing (1) with a suction inlet opening (5) and a pressure outlet opening (6), a pump body (2), a bearing housing (3), and a longitudinally extending shaft (4) for rotatably mounting an impeller within said impeller casing, wherein the impeller casing (1) is provided with legs (7, 17) for mounting the pump on a bed (10), characterized in that the legs (7, 17) are situated spaced apart at the opposite side of the pump to the pressure outlet opening (6) and on opposite sides of a longitudinal plane passing through the pump shaft (4) and the pressure outlet opening (6); said legs (7, 17) each having first and second planar surfaces (27, 37) extending in different directions for mounting of the pump; and further including on opposite sides of the pressure outlet opening (6) brackets (8) with planar mounting surfaces (18, 28) lying substantially in said longitudinal plane.

2. A centrifugal pump structure according to claim 1, characterized in that the first and second planar surfaces (27, 37) of each of the legs (7, 17) are at right angles to each other and that the corresponding first planar surfaces (37) of the legs (7, 17) lie in the same plane as one another.

3. A centrifugal pump structure according to claims 1 and 2, characterized in that the planar surfaces (18, 28) of the brackets (8) are parallel with the second planar surfaces (27) of the legs (7, 17).

4. A centrifugal pump structure according to claim 1, further characterized by an auxiliary support (11) secured to the brackets (8) and securable to the bed (10) for the pump.

5. A centrifugal pump structure according to claim 1, characterized in that the distances between the first and second planar surfaces (27, 37) of the legs (7, 17) and of the planar surface (21) of the auxiliary support (11) are equal to allow the pump to be mounted in three different positions or attitudes on the planar bed (10).

6. A centrifugal pump structure according to claims 1 and 2, characterized in that in the legs (7, 17) each have mounting holes which are situated symmetrically and at an even pitch for allowing the pump to be mounted in all the three different positions or attitudes in one set of corresponding holes in the bed (10).

7. A centrifugal pump structure according to claim 1 characterized in that the planar surfaces (18, 28) of the brackets (8) are machined as concentric counterbores or rings around the mounting holes in the brackets (8).

8. A centrifugal pump according to claim 1, further characterized by an auxiliary support (11) secured to the brackets (8) and securable to the bed (10) for the pump, and the distance of the first and second planar surfaces (27, 37) of the legs (7, 17) and of the planar surface (21) of the auxiliary support (11) are equal to allow the pump to be mounted in three different positions or attitudes on the planar bed (10).

9. A centrifugal pump according to claim 2, further characterized by an auxiliary support (11) secured to the brackets (8) and securable to the bed (10) for the pump, and the distance of the first and second planar surfaces (27, 37) of the legs (7, 17) and of the planar surface (21) of the auxiliary support (11) are equal to allow the pump to be mounted in three different positions or attitudes on the planar bed (10).

10. A centrifugal pump according to claim 9, characterized in that the planar surfaces (18, 28) of the brackets (8) are parallel with the second planar surfaces (27) of the legs (7, 17), further characterized by an auxiliary support (11) secured to the brackets (8) and securable to the bed (10) or the pump, and the distances between the first and second planar surfaces (27, 37) of the legs (7, 17) and the planar surface (21) of the auxiliary support (11) are equal to allow the pump to be mounted in three different positions or attitudes on the planar bed (10).

11. A centrifugal pump according to claim 2, further characterized in that the legs (7, 17) have mounting holes which are situated symmetrically and at an even pitch for allowing the pump to be mounted in all the three different positions or attitudes in one set of corresponding holes in the bed (10).

12. A centrifugal pump according to claim 11, characterized in that the planar surfaces (18, 28) of the brackets (8) are parallel with the second planar surfaces (27) of the legs (7, 17).

13. A centrifugal pump according to claim 12, further characterized by an auxiliary support (11) secured to the brackets (8) and securable to the bed (10) for the pump.

14. A centrifugal pump according to claim 13, characterized in that the distances between the first and second planar surfaces (27, 37) of the legs (7, 17) and the planar surface (21) of the auxiliary support (11) are equal to allow the pump to be mounted in three different positions or attitudes on the planar bed (10).

15. A centrifugal pump structure according to claim 2, further characterized by an auxiliary support (11) secured to the brackets (8) and securable to the bed (10) for the pump.

16. A centrifugal pump structure according to claim 3, further characterized by an auxiliary support (11) secured to the brackets (8) and securable to the bed (10) for the pump.

* * * * *